United States Patent [19]

Tor

[11] 4,423,572

[45] Jan. 3, 1984

[54] WATER-TIGHT INSULATED ROOF CONSTRUCTION FOR HOUSE

[76] Inventor: Edward S. Tor, P.O. Box 70, Fulton, Calif. 95439

[21] Appl. No.: 189,371

[22] Filed: Sep. 22, 1980

[51] Int. Cl.[3] ..... E04D 3/362; E04B 7/02

[52] U.S. Cl. ..... 52/94; 52/90; 52/278; 52/522; 52/547

[58] Field of Search ..... 52/520, 522, 22, 90, 52/94, 545, 276, 278, 529, 536

[56] References Cited

U.S. PATENT DOCUMENTS

| | | | |
|---|---|---|---|
| 665,642 | 1/1901 | Link | 52/22 |
| 1,579,901 | 4/1926 | Whyte | 52/94 X |
| 2,319,857 | 5/1943 | Gray | 52/545 X |
| 2,522,097 | 9/1950 | Cookson | 52/522 X |
| 3,375,622 | 4/1968 | Murray | 52/90 |
| 4,021,981 | 5/1977 | Van Wagoner | 52/90 X |
| 4,109,437 | 8/1978 | Player et al. | 52/536 |
| 4,155,206 | 5/1979 | Player | 52/522 |
| 4,269,012 | 5/1981 | Mattingly et al. | 52/520 X |
| 4,271,653 | 6/1981 | Buchhorn | 52/522 |
| 4,288,951 | 9/1981 | Carlson et al. | 52/94 |

FOREIGN PATENT DOCUMENTS

| | | | |
|---|---|---|---|
| 155843 | 3/1954 | Australia | 52/90 |
| 252371 | 6/1964 | Australia | 52/94 |
| 1161974 | 9/1958 | France | 52/536 |
| 831519 | 3/1960 | United Kingdom | 52/22 |

*Primary Examiner*—Alfred C. Perham
*Attorney, Agent, or Firm*—Alfons Puishes

[57] ABSTRACT

A roof construction disposed for superimposing upon an existing roof to provide for heat insulation and water-proofing employs a novel interlocking panel construction which facilitates assembly and insures water-tightness as well as providing for insertion of insulating material. It is especially adapted for a mobile home application but may also be used on other house structures.

3 Claims, 4 Drawing Figures

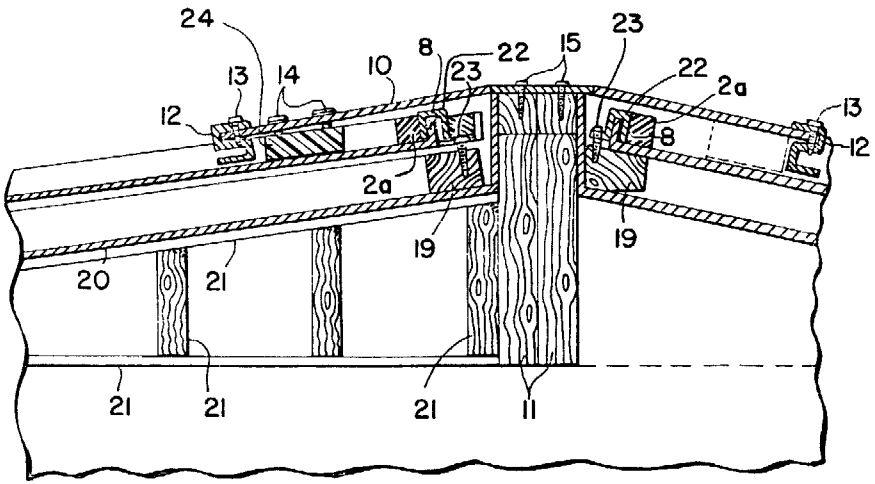
FIG. 3
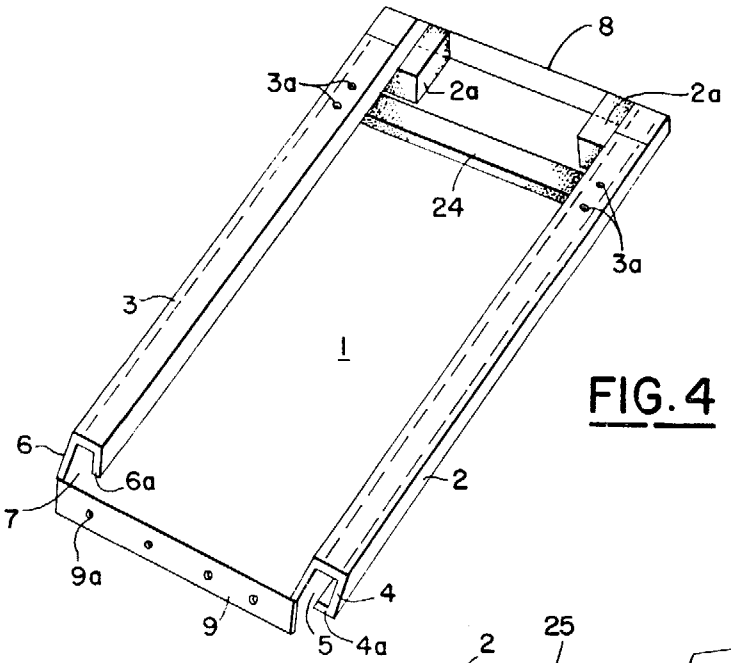
FIG. 4
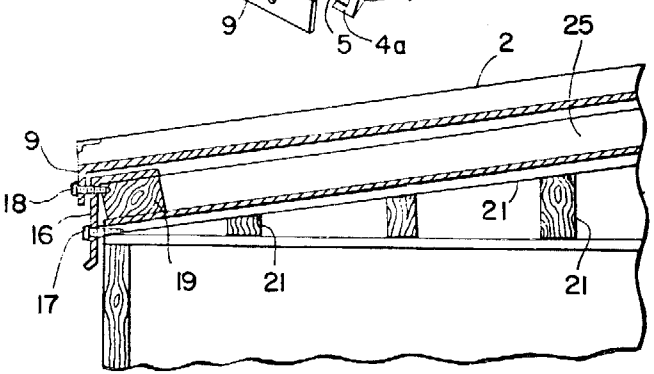

WATER-TIGHT INSULATED ROOF CONSTRUCTION FOR HOUSE

BACKGROUND OF THE INVENTION

Present house construction, particularly of the mobile type, utilizes a metal roof deck in which the panels are joined by a lock seam construction which is prone to leakage particularly after prolonged use involving expansion and contraction. Buildings of this type are also not readily adapted for heat insulation and hence are not accompanied by fuel conservation which is currently an important factor in our present economy. The economy of construction characteristic of low priced homes, particularly of the mobile type, has given rise to this problem.

Asphalt shingles have been employed but present a problem because of the low pitch characteristic of these roofs.

Where sheet metal is used, it is very thin and sections are joined together by what is known as "drive cleats" in the industry which comprise synthetic fillers or gaskets inserted for water tightness. Since these roofs vary in size from 8 feet wide by 30 feet long to as wide as 28 feet and as long as 70 feet, and since the perimeters are stapled, nailed, or screwed to the house structure, the problems created by expansion and contraction through rupturing of the joints are quite evident.

During many years of experience in this art I have not become aware of any basic improvements, patentable or otherwise, which have been made, or any pertinent prior art.

SUMMARY OF THE INVENTION

I have invented a novel construction involving the use of interlocking panels of a unique design which are adapted for installation on existing roofs which solves this problem. My panels utilize seams which are readily interlocked with adjacent panels either by snapping or sliding in to provide a "snap-lock" or "spring-lock" and provide a water-proof connection or joint. My overall construction provides for utilization of an insulating material between the existing roof and the panels, together with suitable flashing and joining means so that the completed structure is completely water-proof. My construction also permits very ready and economical installation upon existing roofs with a minimum amount of labor.

This results in part by absence of rivets, bolts or screws to hold my panels together. The interlocking construction of my joints renders them water repellant. The latter feature is augmented by the location of the joints above the roof surface on which the run-off of the water takes place.

The flexible construction further takes care of the expansion and contraction problem since each panel joint in itself acts as an expansion joint while providing added rigidity to the panel.

DESCRIPTION OF THE DRAWINGS

FIG. 3 is a partial section along the lines 3—3 of FIG. 1 showing details of my roof as installed on the house of FIG. 1.

FIG. 4 is an isometric view of one of the panels of my novel roof construction.

DESCRIPTION OF A PREFERRED EMBODIMENT

Figure 1:
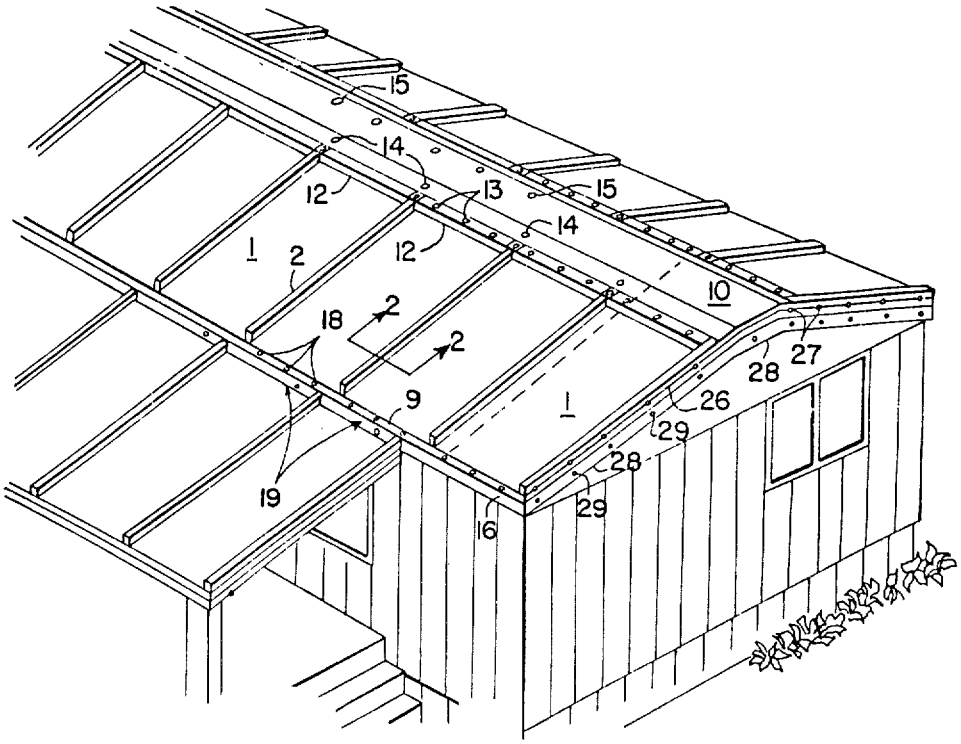
FIG. 1 is an isometric view of a house with the roof of my invention installed upon it.
Figure 2:
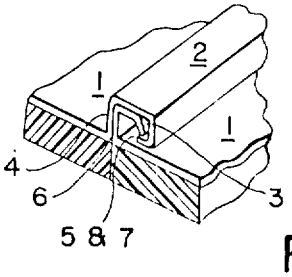
FIG. 2 is a section along the lines 2—2 of FIG. 1 showing the interlocking construction of my roof panels.

Referring now to the figures and particularly to FIG. 1 and FIG. 2, there is seen the roof panel 1 having a female engaging edge 2 and a male engaging edge of the adjacent panel 3. These may be seen in greater detail on FIG. 4 where there are shown a styrene water-proof sealing strip 2*a* and screw holes 3*a*. The female engaging edge 2 which is integral with one of the raised longitudinal edges of the panel, has a hollow square cross-section 4*a*, notch opening 5, and a leading lip 4*a*. The opposite or male engaging section 3, which forms an integral part of the opposite raised longitudinal edge, has a trapezoidal cross-section 6 with a notch or opening 7 leading a protruding lip 6*a*. The method of joining two panels is shown on FIG. 2 and may be effected by either snapping member 6 into member 4, using the spring tension of the latter or by sliding the panel in longitudinally so that it assumes the joint connection shown on FIG. 2. The convenience of assembling the panels, as well as the water-proof nature of the joint should now be evident. At the opposite, or short ends of my panel, there is seen at the upper end an upper flap 8 projecting upwards and a lower flap 9 projecting downwards. A styrene sealing strip 2*a* is positioned in the corner on the upper edge of the panel to insure water resistance at the ends of the joints and a second styrene strip 24 is positioned across the panel and adhesively connected thereto at a position opposite the holes 3*a* in the panel joints. The method of securing this panel to the rest of the roof structure will now be described with special reference to FIG. 2 and FIG. 3. The body of my panel 1 is constructed of light gauge sheet iron or aluminum as are the other members to be described herein. Ridge cap 10 is disposed for covering over the ridge pole of the building and especially the roof beams 11. "Z"-shaped flashing strips 12 are fastened along the outer edges of ridge cap 10 and press against the top surface of panel 1. They are held in position against the ridge cap by screws 13. Panel screws 14, which are equipped with water-proof washers under their heads, fasten the ridge cap 10 to the panel edges through screw holes 3*a*. The central or peak section of ridge cap 10 is fastened to roof beams 11 by means of screws 15.

Longitudinal wall flashing 16 is fastened to the longitudinal wall of the building by means of screws 17. This in turn is joined to lower panel flap 9 by means of screws 18.

I employ 2 by 2 wooden end strips 19 along the edges of the panel, to which the panel is secured at the eaves by means of screws 18, previously mentioned, and at the opposite end as described below.

The metal deck of the existing roof is shown at 20 and the existing supporting roof structure is shown by the various members 21. At the upper end of my panel there is positioned also another 2 by 2 strip 19 which provides a 2" space which may be filled with styrene or other suitable insulation medium 25.

Tie clip 22 clamps over upper lip 8 of may panel tightly and is fastened to end strip 19 by means of screws 23. The end panels are equipped with downward projecting side flaps 26 which are joined by means of screws 27 to the building end flashing 28 which corresponds to the longitudinal flashing 16 previously described. The screws 30 hold the building end flashing in position similar to the screws 17, also previously described.

It is thus seen how I provide a completely flexible and integral water-tight structure incorporating an insulating medium and providing for expansion and contraction as well as ready replacement of individual roof panels if they become damaged.

It should now be evident that my construction solves the long standing roof leakage and maintenance problem which to my knowledge has existed for many years in this industry, while at the same time providing convenient and economical construction as well as simplification of maintenance not heretofore attained by any existing structures.

I claim:

1. A water-tight roof construction for a house having a ridge pole and a plurality of covering panels equipped with upper and lower bent edges and comprising:

a plurality of interlocking metallic panels fastened to and completely covering an existing roof deck;

heat insulating means positioned between said panels and said roof deck;

a longitudinal ridge cap flashing positioned along the top central ridge of said roof;

said ridge cap flashing comprising a flat metallic strip overlapping the upper edges of said panels and being fastened to said panels and said roof deck;

a longitudinal wall flashing positioned along the lower edges of said panels;

said wall flashing positioned along the lower edges of said panels;

said wall flashing comprising a metallic strip of right-angular configuration;

one leg of said angular strip being positioned horizontally and being overlapped by the lower bent edges of said panels and being fastened thereto;

the other end of said strip being positioned vertically and being fastened to said panels and the vertical frame of said house;

water sealing means inserted between the upper edges of said panels and said existing roof deck.

2. The construction of claim 1 in which said fastening between said ridge cap flashing and said panels comprises:

a bar of generally "Z"-shaped configuration;

one end of said bar engaging tightly an edge of said flashing and being fastened thereto;

the other edge of said bar making spring contact with the upper surface of said panel.

3. The construction of claim 1 in which said fastening of said panels to said roof deck comprises a tie-down clip;

said clip being generally of right angular configuration and having a slot on its first vertical leg;

said slot being disposed to tightly engage the bent-up upper edge of said panels;

the second horizontal leg of said clip being fastened to said existing roof deck.

* * * * *